US012163416B2

(12) United States Patent
Onikoyi et al.

(10) Patent No.: US 12,163,416 B2
(45) Date of Patent: Dec. 10, 2024

(54) SYSTEMS AND METHODS FOR FLOW RATE VALIDATION IN A WELL SYSTEM

(71) Applicant: SAUDI ARABIAN OIL COMPANY, Dhahran (SA)

(72) Inventors: Abiola S. Onikoyi, Khurais (SA); Mohammed J. Shakhs, Al Khobar (SA); Said Rifat, Medina (SA); Saud A. Al-Shuwaier, Al Khobar (SA); Fahad M. Al-Meshal, Al Khobar (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 114 days.

(21) Appl. No.: 17/823,862

(22) Filed: Aug. 31, 2022

(65) Prior Publication Data

US 2024/0068357 A1 Feb. 29, 2024

(51) Int. Cl.

| | |
|---|---|
| ***E21B 47/008*** | (2012.01) |
| ***E21B 43/20*** | (2006.01) |
| ***E21B 47/10*** | (2012.01) |

(52) U.S. Cl.

CPC ..... *E21B 47/008* (2020.05); *E21B 43/20* (2013.01); *E21B 47/10* (2013.01); *E21B 2200/20* (2020.05)

(58) Field of Classification Search

CPC ..... E21B 47/008; E21B 43/20

See application file for complete search history.

(56) References Cited

U.S. PATENT DOCUMENTS 7,516,023 B2 4/2009 Ferreira et al.
2012/0095733 A1* 4/2012 Rossi ..... E21B 43/00 703/2

FOREIGN PATENT DOCUMENTS

WO 2017062273 A1 4/2017

* cited by examiner

*Primary Examiner* — Robert E Fuller

(74) *Attorney, Agent, or Firm* — Osha Bergman Watanabe & Burton LLP

(57) ABSTRACT

A system for validating a flow rate of a water injection well includes a first data source providing operating data associated with the well, a data repository, a digital model of the well, a second data source, and a processor. The processor is configured to obtain operating data, including a measured flow rate, historical data, and the digital model, determine a modelled flow rate using the digital model based on the historical injection data and the operating data, compare the measured flow rate with the modelled flow rate to determine a delta, receive a second measured flow rate from the second data source, compare the second measured flow rate to the modelled flow rate to determine a second delta, and in response to determining that the second delta does not exceed the threshold value, automatically generate a request for remediation of the first data source.

19 Claims, 5 Drawing Sheets

SYSTEMS AND METHODS FOR FLOW RATE VALIDATION IN A WELL SYSTEM

BACKGROUND

Every day, ninety million barrels of oil and gas are used to produce energy to power world and all its inhabitants. The oil and gas formed over several millions of years reside deep under the earth's surface and flows to the surface through wells drilled in strategic locations.

In some cases, water may be injected into the perimeter of underground reservoirs holding the oil through a water injector well in order to displace the oil towards the oil production well and eventually to the surface. In such water injection wells, it is desirable to accurately measure and track the water flow rate for purposes of reservoir management strategy and oil production rate, among other things.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Embodiments disclosed herein relate to a system for validating a flow rate of a water injection well. The system includes a first data source associated with the water injection well, and configured to provide operating data associated with the water injection well, the operating data including a first measured flow rate, a data repository for storing historical injection data for the water injection well, a digital model corresponding to the water injection well, a second data source configured to provide a second measured flow rate associated with the water injection well, and a processor. The processor is configured to obtain the operating data, the historical data, and the digital model corresponding to the water injection well, determine a modelled flow rate using the digital model based on the historical injection data and the operating data, compare the first measured flow rate with the modelled flow rate to determine a first flow rate delta, in response to determining that the first flow rate delta exceeds a predetermined threshold value, receive the second measured flow rate from the second data source, compare the second measured flow rate to the modelled flow rate to determine a second flow rate delta, and in response to determining that the second flow rate delta does not exceed the predetermined threshold value, automatically generate a request for remediation of the first data source.

The operating data may further include one or more of a flow pressure, flow temperature, and a surface choke setting.

The processor may be further configured to determine unavailability of one or more of the operating data, and automatically generate a request to verify the first data source.

The first data source may include a semi-permanent flow rate measurement device.

The semi-permanent flow rate measurement device may include an orifice plate mounted on a portion of the water injection well.

The second data source may include a portable flow meter removably positioned on a portion of the water injection well.

The modelled flow rate may be determined based on a flow rate equation and a choke equation.

The processor may be further configured to, in response to determining that the first flow rate delta exceeds the predetermined threshold value, and prior to receiving the second measured flow rate from the second data source, automatically generate a request to modify the digital model.

The digital model may be modified based on a well system modification.

The well system modification may include one or more of a shut-in pressure change, a wireline change, a well workover of a corresponding production well, a well recompletion of a corresponding production well, a change in water pressure supply to the water injection well, and addition of a new production well to a field.

According to further embodiments, a method for validating a flow rate of a water injection well is provided. The method includes receiving, from a first data source associated with the water injection well, operating data associated with the water injection well, the operating data including a measured flow rate, obtaining, from a repository, historical injection data for the water injection well, obtaining a modelled flow rate from a digital model corresponding to the water injection well based on the historical injection data and the operating data, comparing the measured flow rate with the modelled flow rate to determine a first flow rate delta, in response to determining that the first flow rate delta exceeds a predetermined threshold value, receiving, from a second data source, a second measured flow rate associated with the water injection well, comparing the second measured flow rate to the modelled flow rate to determine a second flow rate delta, and in response to determining that the second flow rate delta does not exceed the predetermined threshold value, automatically generating a request for remediation of the first data source.

The operating data may further include one or more of a flow pressure, flow temperature, and a surface choke setting.

The method may further include determining unavailability of one or more of the operating data, and automatically generating a request to verify the first data source.

The operating data may be received via a wired connection from the first data source.

The method may further include positioning by a technician, the second data source on a portion of the injection well, wherein the second measured flow rate is received wirelessly from the second data source.

The measured flow rate with the modelled flow rate comprises a first comparison based on a flow equation and a second comparison based on a choke equation.

The method may further include, in response to determining that the second flow rate delta exceeds the predetermined threshold value, automatically generating a request to modify the digital model.

The method may further include modifying the digital model based on a well system modification.

The well system modification may include one or more of a shut-in pressure change, a wireline change, a well workover of a corresponding production well, a well recompletion of a corresponding production well, a change in water pressure supply to the water injection well, and addition of a new production well to a field.

According to still further embodiments, a non-transitory computer-readable medium storing instructions is provided. When the instructions are executed by a processor, the processor is caused to perform operations including, receiving, from a first data source associated with a water injection well, operating data associated with the water injection well, the operating data including a measured flow rate, obtaining, from a repository, historical injection data for the water injection well, obtaining a modelled flow rate from a digital model corresponding to the water injection well based on the historical injection data and the operating data, comparing the measured flow rate with the modelled flow rate to determine a first flow rate delta, in response to determining that the first flow rate delta exceeds a predetermined threshold value, receiving, from a second data source, a second measured flow rate associated with the water injection well, comparing the second measured flow rate to the modelled flow rate to determine a second flow rate delta, and, in response to determining that the second flow rate delta does not exceed the predetermined threshold value, automatically generating a request for remediation of the first data source.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
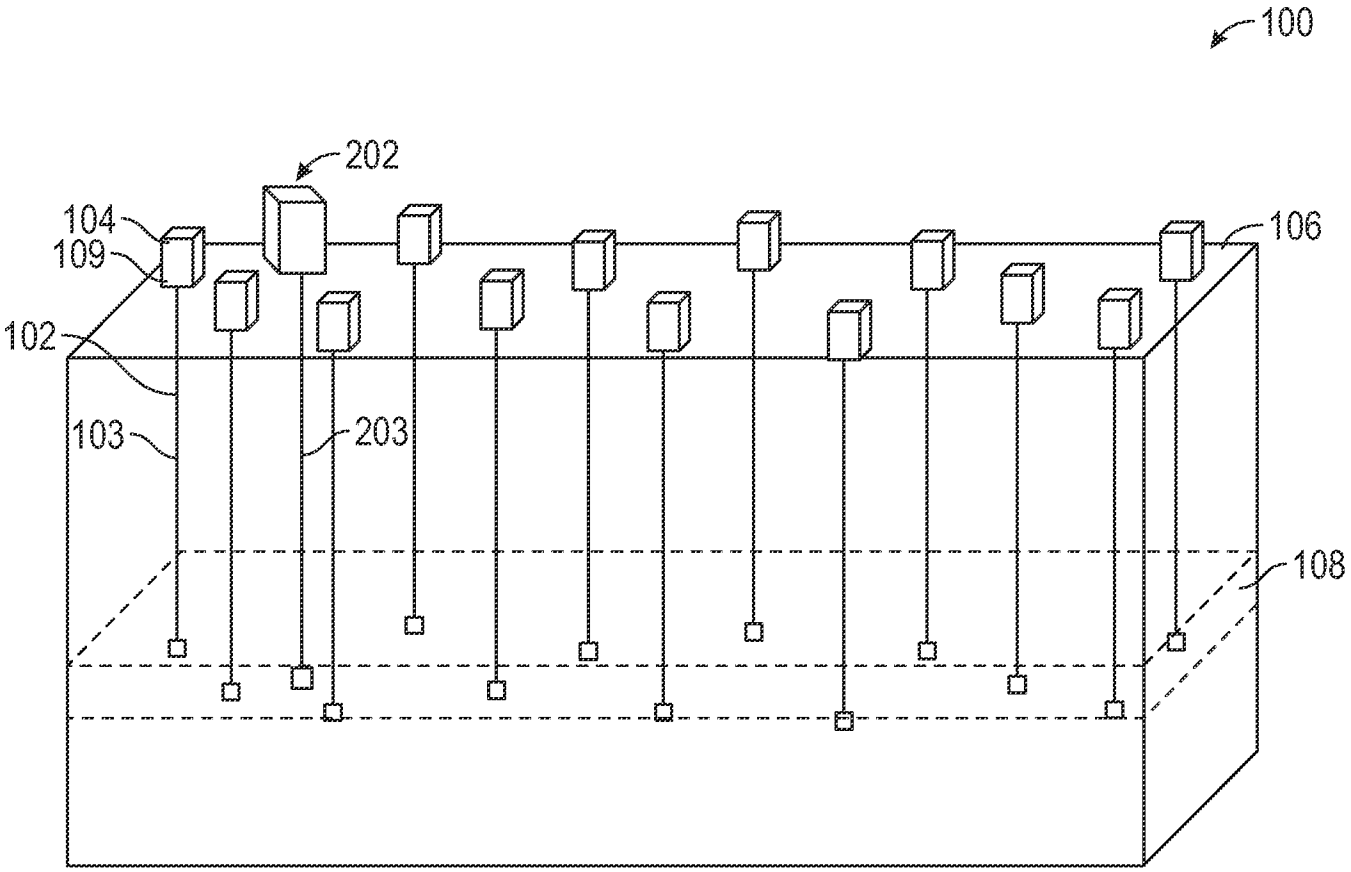
FIG. 1 shows an illustrative well site in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers e.g., first, second, third, etc. may be used as an adjective for an element i.e., any noun in the application. The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed or precede the second element in an ordering of elements.

Regarding the figures described herein, when using the term "down" the direction is toward or at the bottom of a respective figure and "up" is toward or at the top of the respective figure. "Up" and "down" are oriented relative to a local vertical direction. However, in the oil and gas industry, one or more activities take place in a vertical, substantially vertical, deviated, substantially horizontal, or horizontal well. Therefore, one or more figures may represent an activity in deviated or horizontal wellbore configuration. "Uphole" may refer to objects, units, or processes that are positioned relatively closer to the surface entry in a wellbore than another. "Downhole" may refer to objects, units, or processes that are positioned relatively farther from the surface entry in a wellbore than another. True vertical depth is the vertical distance from a point in the well at a location of interest to a reference point on the surface.

For bringing fluids e.g., hydrocarbons out of a subterranean wellbore to the surface of the Earth, various techniques such as water injection may be used. Water injection may include, for example, a pump and associated components configured to inject water into areas surrounding a hydrocarbon well such that the water aids in forcing the hydrocarbons out of the well and to the surface.

Notably, hydrocarbon production from one or more wells coupled with a water injection well may be impacted by various flow characteristics such as, for example, a flow rate of the water being injected into the ground. It is beneficial to be able to verify and track the amount of water injected over time and to control current injection rates to meet production metrics set for one or more hydrocarbon wells.

The systems and methods in accordance with embodiments of the disclosure are therefore configured to verify and remediate water injection flow rates to a hydrocarbon well, thereby enhancing data accuracy and quality of online flow sensors, among other things. Verification may utilize one or more data sources including sensors, data repositories, etc. and a digital model representing the water injection well. For example, systems and methods of the present disclosure may involve obtaining operating data from one or more data sources e.g., sensors associated with the well, operating databases, document databases, etc. to determine an actual flow rate of the water injection, and calculating, using a well model e.g., provided by commercially available software such as, for example, PROSPER™ and/or PIPESIM™, a modelled flow rate of water based on operational characteristics of the water injection well. Comparisons may then be made between the actual flow rate and the modelled flow rate to determine accuracy of the actual value. Remediation of the certain aspects of the one or more data sources may be undertaken when the values are not sufficiently close, and if correction not achieved, the well system may be retested and remodeled.

FIG. 1 depicts an illustrative field 100 in accordance with one or more embodiments including one or more production wells 102 and one or more water injection wells 202.

The field 100 is a geographical region or location that includes a plurality of production wells 102 configured to produce fluids from below the surface and one or more water injection wells 202 configured to inject water below the surface 106 into a reservoir 108. The field 100 may include the surface equipment 104 of the production wells 102 and water injection wells 202, such as pumps, pipelines, tanks, separators, etc. Each production well 102 has a wellbore 103 that extends from a surface 106 location into a reservoir 108. Similarly, each water injection well 202 has a wellbore 203 extending from the surface 106 to a different location in the reservoir 108.

The reservoir 108 is a formation containing fluids intended to be produced such as hydrocarbons e.g., oil, gas, etc. The wells 102, 202 shown in FIG. 1 are vertical conventional wells. However, those skilled in the art will appreciate that the wells 102, 202 in the field 100 may have any wellbore trajectory such as, for example, horizontal, without departing from the scope of this disclosure.

The field 100 of FIG. 1 is shown having thirteen production wells 102 and one water injection well 202. Importantly, the number of wells of the field 100 is not intended to be limiting, and the field 100 may have any combination of production wells 102 and water injection wells 202 without departing from the scope of this disclosure. For example, each production well 102 may be provided with a designated water injection well 202. Alternatively, a single water injection well 202 may be provided for a desired number of production wells 102 (e.g., one water injection well 202 for three production wells 102).

According to some embodiments, the production wells 102 may be oil wells intended to bring liquid-phase hydrocarbons 109 out of the reservoir 108. An oil well may have associated gasses such as hydrocarbon gas, hydrogen sulfide gas, and carbon dioxide gas either in gaseous form, dissolved in the carrier liquid, or in liquid form. The water injection well 202 may be configured to introduce water into the reservoir 108 with the intent of displacing the hydrocarbons 109 toward one or more of the production wells 102.

Figure 2A:
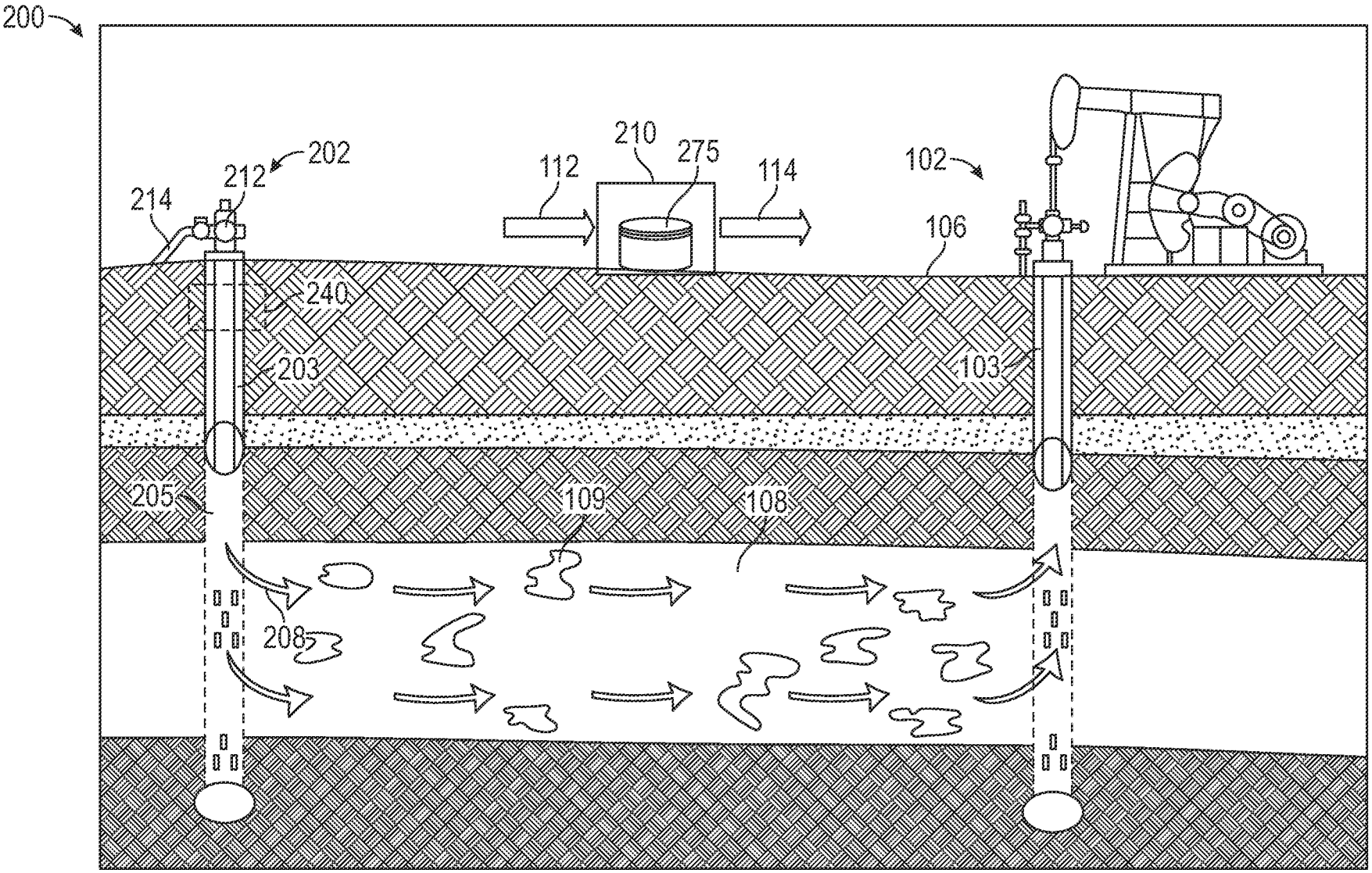
FIG. 2A shows one well of the well site of FIG. 1, including an illustrative water injection well according to embodiments of the present disclosure.

FIG. 2A highlights an illustrative well system 200 including one or more water injection wells 202 and one or more production wells 102. A computer system 210 is provided for performing operations according to the present disclosure is also provided. The wellbore 203 extending into the reservoir and provided with perforations enabling transfer of the injection fluid (e.g., water) into the reservoir 108.

The water injection well 202 may be provided with components configured to enable injection of water into the reservoir 108 to force the hydrocarbons 109 toward the production well 102. For example, the water injection well 202 may include a choke (not shown), a water supply line 214, piping 205, and one or more pumps 212 configured to pump water 208 downhole through the wellbore 203 to the reservoir 108.

The computer system 210 may be provided at a location on the surface 106 and may be connected to the one or more devices (e.g., sensors, controllers, etc.) present in the field 100 by any suitable connection technique, such as, for example, wireless (e.g., Wi-Fi, cellular, Bluetooth, etc.) or wired Ethernet, serial cable, twisted pair, etc.

The computer system 210 may be configured to execute and/or maintain one or more auxiliary systems for enabling functionality of the present disclosure. For example, the computer system 210 may include one or more repositories 275 (e.g., a database) for storage and retrieval of data, corresponding to, for example, inputs, outputs, digital models, etc. used to implement the systems and methods of the disclosure. Any suitable database may be implemented as the repository 275 e.g., file system, relational database management system RDBMS etc. without departing from the scope of the present disclosure. Moreover, any suitable number of repositories may be implemented as desired for storage of varying data (e.g., a repository for digital models, a repository for historical data, etc.)

The computer system 210 may be configured to store and select, based on modeling criteria, a model corresponding to one or more water injection wells 202. For example, the computer system 210 may receive data from a user based on structure of a water injection well corresponding to depth, rock formation, and field conditions, etc. Based on such information, among other things, a model (e.g., a PIPESIM™ model) may be created and/or selected from a list of available models for use based on other past wells that have been modeled successfully.

The computer system 210 may be configured to receive a plurality of data inputs 112 associated with each water injection well 202, as well as the production wells 102, in the field 100. The inputs may include, for example, operating data obtained from one or more data sources, e.g., measured flow rate, measured pressure, measured temperature, choke settings, etc. among other things. According to some embodiments the structural data may facilitate selection of the digital model for use with a particular water injection well 202.

According to some embodiments, real-time injection data (e.g., volume, flow rate, temperature, pressure, etc.) from one or more data sources associated with a water injection well 202 may be obtained by the computer system 210. The real-time injection data may be stored, e.g., in the repository 275, as historical injection data to enable determination of, for example, a volume of water that has been injected into the reservoir 108 over time.

The inputs 112 may be used by the computer system to produce a plurality of outputs 114. The outputs 114 may include, for example, modelled flow rates, trouble tickets, digital model corrections, etc. For example, based on operating data and historical water injection data provided as input 112 to the computer system 210, a modelled flow rate may be determined using a selected digital model corresponding to the water injection well 202 under consideration.

Figure 2B:
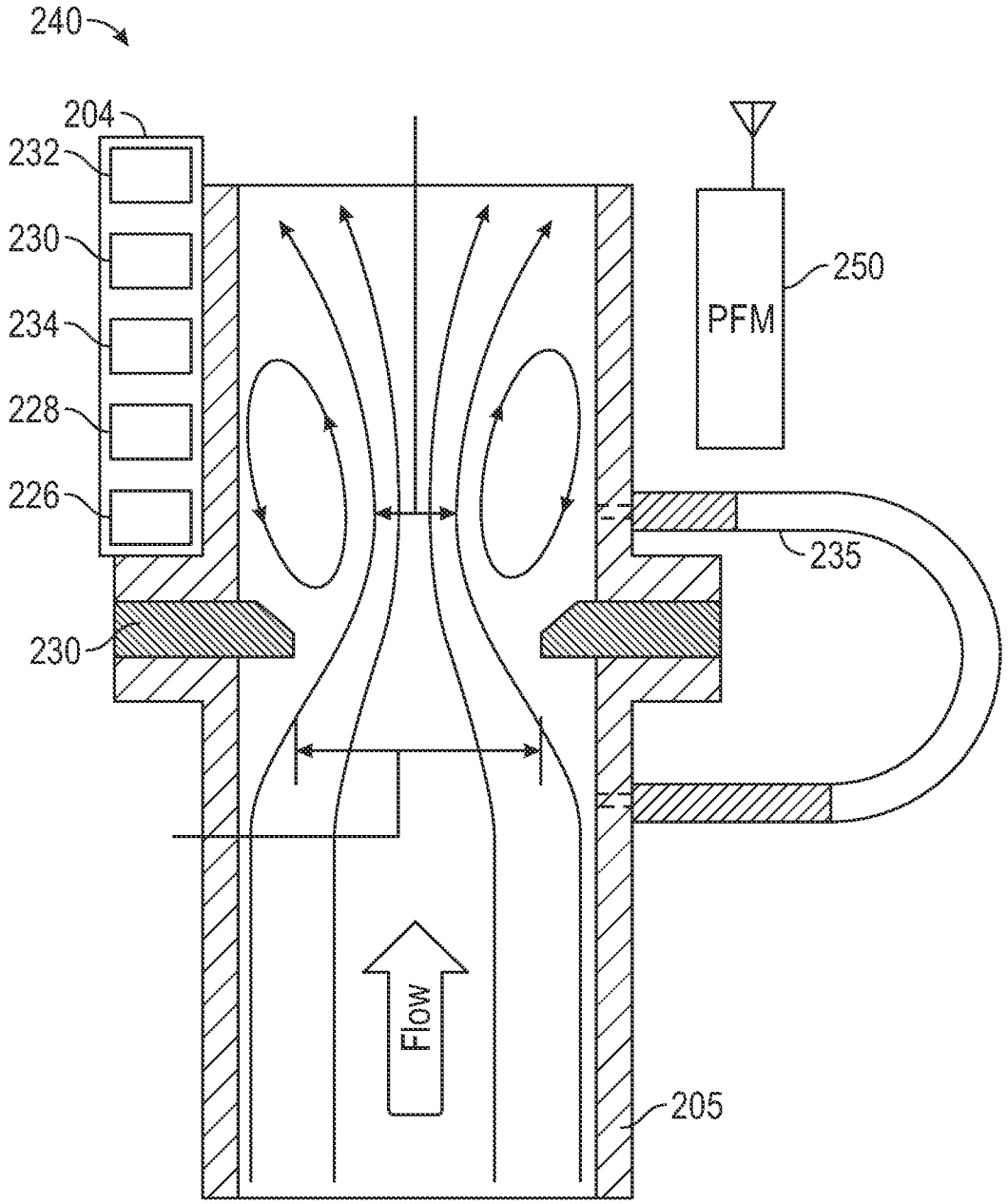
FIG. 2B shows an illustrative view in cross section of a highlighted portion of FIG. 2A according to one or more embodiments of the present disclosure.

Element 240 of FIG. 2A calls out a portion of the water injection well 202 that will be described in greater detail with regard to FIG. 2B. Particularly, FIG. 2B shows an illustrative view in cross section of the dashed box portion 240 of FIG. 2A. As shown, the water injection well 202 includes a data source 204 configured to provide operating data related to operation of the water injection well 202. For example, the data source 204 includes a flow rate sensor 226 configured to measure and provide information including a measured flow rate for the water flowing in the piping 205 of the water injection well 202, a pressure sensor 228 configured to measure and provide information regarding a flow pressure, a temperature sensor 230 configured to measure and provide information related to flow temperature, and a choke sensor 232 configured to measure an opening degree of an adjustable choke associated with the water injection well 202. More or fewer sensors may be provided as desired without departing from the scope of the present disclosure.

For purposes of simplifying the discussion, the sensors 226, 228, 230, and 232 of data source 204 are shown in a common location within data source 204, however, the sensors 226, 228, 230, and 232 may be positioned individually at any suitable location of the water injection well 202, as desired. For example, the pressure sensor 228 may be provided near the surface 106, while the flow rate sensor 226 may be provided further down the wellbore 203.

According to some embodiments, the flow rate sensor 226 may include an orifice plate measurement configuration having an orifice plate 230 and a pressure differential measuring device 235. For example, a square-edged concentric orifice plate 230 may be used. This is intended as illustrative only, and when the flow rate sensor 226 is implemented as an orifice plate measurement configuration, any suitable orifice plate may be implemented, for example, a concentric orifice plate, an eccentric orifice plate, or a segmental orifice plate, etc.

The pressure differential measuring device 235 may comprise any suitable device for determining pressure change across the orifice plate 230. For example, the pressure differential measuring device 235 may comprise a manometer configured to determine differential pressure measurement across the orifice plate and to provide the differential pressure measurement as information to the data source 204.

Some portions of the flow rate sensor 226 may be permanently or semi-permanently mounted to the piping 205 while other portions may be removably mounted to the piping 205. For example, a frame of the flow rate sensor 226 and the pressure differential measuring device 235 may be permanently mounted to the piping 205, while an orifice plate 230 mounted inside the piping 205 may be removed for maintenance and replacement. According to embodiments of the disclosure, "semi-permanent" is intended to indicate selective permanence, i.e., the mounting is intended to last the life of the water injection well 202, but should replacement be desirable, removal is possible.

The data source 204 may include one or more communication interfaces 234 for transmitting and/or obtaining operating data via a well network. The communication interface 234 may provide wired connection (e.g., twisted pair, ethernet, USB, etc.), wireless connection (WiFi, 4G/5G, Bluetooth, etc.), or both. For example, a wired connection (e.g., using HART protocol) may be provided for the data source 204. Although one communication interface 234 is shown, any number of communication interfaces 234 may be provided. For example, each sensor 226, 228, 230, 232 may be provided with a dedicated communication interface 234 to provided desired operating data of the water injection well 202.

A second data source 250 is shown at FIG. 2B in proximity to piping 205. The second data source 250 is a device enabling a second flow rate measurement of water flowing in the piping 205 of the water injection well 202, independent of the operating data obtained from the flow rate sensor 226. The second data source 250 may comprise, for example, a portable flow meter 250 that may be transported and placed in proximity or even in contact with the piping 205 by a user (e.g., a technician) for purposes of obtaining a second measurement of flow rate within the piping 205. The second measurement is independent of the operating data obtained from the flow rate sensor 226. For example, when operating data of a water injection well 202 indicates that an anomaly may be present in measurements of the flow rate sensor 226 (e.g., a measured flow rate not in accord with a modelled flow rate), a technician may be dispatched with a portable flow meter 250 to obtain a second measured flow rate within the piping 205, as will be described in greater detail below.

A suitable portable flow meter 250 may comprise a mobile device capable of wireless communication (e.g., 4G/5G, WiFi, etc.) and that may be hand carried by a user to a desired location in the field 100 for placement in proximity to piping 205 of a water injection well 202. According to some embodiments, a portable flow meter 250 may use ultrasonic technology to determine a real-time flow rate continuously when placed in proximity to the piping 205. The portable flow meter 250 may provide the second measured flow rate to the computer system 210 as an input 112, for example.

The second data source 250 may be calibrated, for example, by a technician at regular intervals and/or just prior to being dispatched for taking a second measured flow rate reading. For example, a suitable calibration process may be performed at a workshop when a trouble ticket has been received to dispatch the second data source 250 to a water injection well 202. Calibration of the second data source 250 may include standard techniques for ensuring accuracy and precision of the data provided by the second data source 250.

Figure 3:
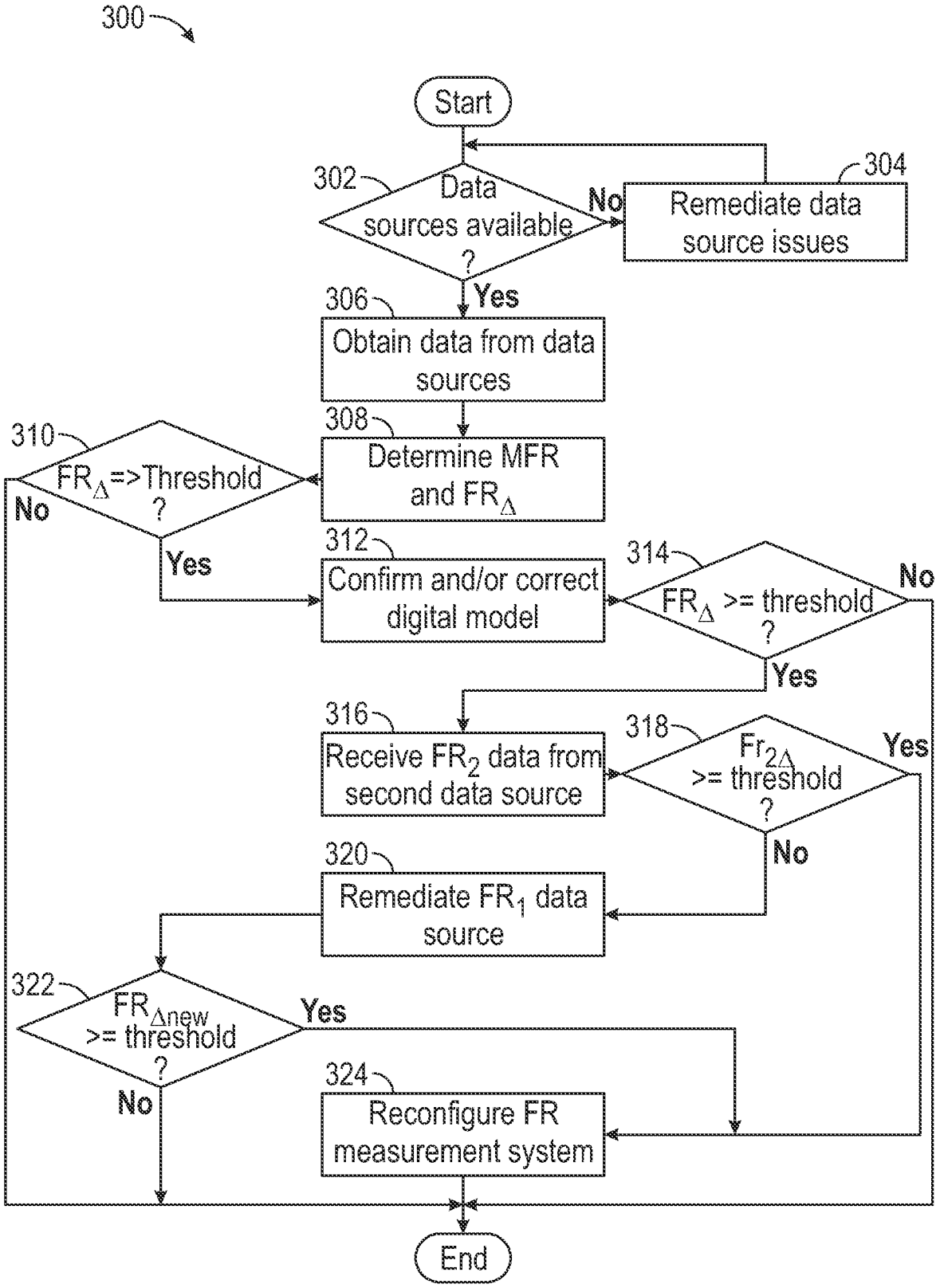
FIG. 3 shows a flowchart highlighting an illustrative method for flow rate validation according to one or more embodiments of the present disclosure.

FIG. 3 depicts a flowchart illustrating a method for validating a flow rate in a water injection well 202, according to one or more embodiments of the disclosure.

Specifically, FIG. 3 illustrates a method, according to embodiments of the disclosure, for validating a flow rate of a water injection well 202 and remediating aspects of the water injection well 202 when validation cannot be achieved. Computer instructions for causing a processor to carry out the method outlined in FIG. 3 may be stored on a non-transitory computer readable medium for execution by the computer system 210. Further, one or more blocks in FIG. 3 may be performed by one or more components as described with respect to FIGS. 1 and 2A-2B. While the various blocks in FIG. 3 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, a check may be performed to determine the availability of one or more data sources associated with the water injection wells 202 in the field 100 (step 302). For example, a determination may be made as to availability of data provided by the data source 204 and sensors associated therewith. In other words, the computer system 210 may communicate with the data source 204 to determine whether the data source 204 is available (e.g., connected and operational) and if so, if one or more of the sensors 226, 228, 230, and 232 are providing data. Similarly, the computer 210 may communicate with the repository 275 (e.g., a server providing access to the repository 275) to determine availability of historical injection data, well models, etc.

If the data source 204 is not available or if one or more of the sensors 226, 228, 230, 232 are not providing data (step 302: no) the computer system 210 may signal to a user that remediation of the data sources 204 may be desirable (step 304). For example, when the computer system 210 is unable to access information from the flow sensor 226, a user may be dispatched to determine whether the flow sensor 226 is online. Similarly, when data cannot be retrieved form the repository 275 (e.g., historical injection information, digital model information, etc.) the applications and/or hardware related to operation of the repository (or repositories) may be restarted. Additionally, network connections may be verified to ensure connectivity to the system.

When operating data cannot be obtained from data source 204 and/or one or more of its associated sensors 226, 228, 230, 232, the computer system 210 may automatically issue a trouble ticket intended to cause a user to check on communications infrastructure and health of the components of the data source 204, and email the trouble ticket to a registered user. For example, when a measured flow rate cannot be obtained from flow rate sensor 226, the communications connection and state of the flow rate sensor may be verified by a technician.

When the computer system 210 verifies that the desired data sources and connections are available (step 302: yes), the computer system 210 obtains the data for performing operations related to verification of the flow rate in the water injection well 202 (step 306). For example, the computer system 210 may begin obtaining real-time measured flow rate data from the flow rate sensor 226. The computer system may also obtain the historical injection data corresponding to the water injection well 202 being verified.

In addition, the computer system 210 obtains a digital model corresponding to the water injection well 202 being verified. For example, a modeling application provided by, for example, a commercially available program executed by the computer system 210 may be used for storage, retrieval, and execution of one or more models from a repository 275. Commercially available programs available as of the priority date of this patent application include, for example, reservoir simulation modeling packages Petrel™, PIPESIM™, and PROSPER™. This list is not intended to be limiting, nor are the determinations intended to be limited to the commercially available program. Any suitable software e.g., custom-coded applications providing similar functionality to that described may also be implemented without departing from the scope of the present disclosure.

According to some embodiments, the well model corresponding to the water injection well 202 may be initialized with historical injection data associated with the water injection well 202 and the real time operating data from data source 204. For example, pressure, temperature, choke setting, etc. may be obtained real time from the data source 204.

According to some embodiments, inputs to the model may include, for example:

1. Well data such as casing or liner size, weight, grade; tubing size, weight, grade type and thread, plus condition; pump setting depth measured depth and vertical depth; perforated or openhole interval; and well plug-back total depth measured and vertical;
2. Well-fluid conditions such as specific gravity of water;
3. Power sources for a pump for the water such as available primary voltage, frequency, and power source capabilities; and
4. Possible well makeup such as sand, scale deposition, corrosion, paraffin/asphaltenes, emulsion, gas, and high reservoir temperature.

A modelled flow rate for the well and a difference (i.e., delta, shown as "A" in FIG. 3) between this modelled flow rate and the measured flow rate obtained at step 306 may then be determined using the digital model (step 308). For example, the modelled flow rate may be determined using both a flow equation of the model and choke equation of the model. For example, a baseline flow equation can be stated as at 1) below.

$$Q=V*A \quad (1$$

where V is the fluid velocity and A is the area. Notably, various correlations such as Moody's correlation, Colebrook-white correlation etc. may be applied depending on the state of flow (laminar or turbulent). The correlations compute flowrate as a function of fluid velocity and area of flow.

Mass flow rate for a choke equation can be stated as shown at (2.

$$Q_{sc} = 12A_{bean}\sqrt{\frac{2g\rho_{ns}\Delta P}{\left[\frac{f_L}{(Z_L c_L)^2}+\frac{f_G}{(Z_G c_G)^2}\right]}} \quad (2$$

where $f_L$ and $f_G$ are the liquid and gas phase friction, $c_L$ and $c_G$ are the liquid and gas flow coefficients, and $A_{beam}$ is the choke cross sectional area. Further, ΔP is the pressure drop given at (3 below.

$$\Delta P = f_L\Delta P_L + f_G\Delta P_G \quad (3$$

Where $\Delta P_L =$ $$\left(\frac{1}{2g\rho_{ns}}\right)\left[\frac{q}{12Z_L c_L A_{bean}}\right]^2 \text{ and } \Delta P_G = \left(\frac{1}{2g\rho_{ns}}\right)\left[\frac{q}{12Z_G c_G A_{bean}}\right]^2$$

ZL=1 and is the liquid compressibility factor, $Z_G=Z_G$ (k,DP, $P_{up}$) is the gas compressibility factor, and $\rho_{ns}=f_L P_L+f_G P_G$ corresponding to the no slip density. This may be used to describe the flowrate through a choke valve with a cross-sectional area of A.

A comparison is then made to determine whether the determined delta is greater than a threshold value (step 310). According to some embodiments, the threshold value may be set in advance and may apply for all water injection wells 202 in the field 100. For example, a threshold may be set as a relative, percentage-based value, and may range from ±0.1% to ±10%. One of skill will recognize that these ranges and level of precision are illustrative, and may vary based on a particular application as desired (e.g., where greater granularity is desired for flow rate verification).

When the flow rate delta between the measured flow rate and the modelled flow rate determined by the digital model is less than the threshold (step 310: no), validation of the actual flow rate measured by the flow sensor 226 is achieved, and the process is terminated for the present water injection well 202.

When the flow rate delta between the measured flow rate and the modelled flow rate determined by the digital model is greater than or equal to the threshold (step 310: yes), the computer system 210 may request or automatically carry out confirmation or correction of the digital model selected as corresponding to the water injection well 202 (step 312). For example, an alert may be provided to an operator that data associated with the digital model should be verified and modified to improve correspondence with the characteristics of the well (e.g., wireline, shut-in, etc.) For example, a well may be shut in due to a leak or for a maintenance activity wherein the current rate is zero. The digital model can be modified to reflect the new state of the well. Similarly, a well may be isolated for a wireline data capture activity. The digital model may be updated with the new state of the wells in the field in order to perform the presently described flow rate validation. Additional examples include workover of a corresponding production well 102 in the field 100, recompletion of a corresponding production well 102 in the field 100, a change in water pressure supply in the water supply line 214 to the water injection well 202, and addition of a new production well 102 or a new water injection well 202 to the field 100.

Following confirmation and/or correction of the model, the modelled flow rate may be redetermined (e.g., via the flow equation and the choke equation) and compared with the threshold value (step 314). When the flow rate delta between the measured flow rate and the modelled flow rate determined by the revised digital model is less than the threshold (step 314: no), validation of the actual flow rate is achieved, and the process is terminated for the present water injection well 202.

When the flow rate delta between the measured flow rate and the modelled flow rate determined by the revised digital model is greater than or equal to the threshold (step 314: yes), the computer system 210 may request to receive a second measured flow rate to be provided by the second data source 250 (step 316). For example, the computer system 210 may automatically generate a trouble ticket and send (e.g., via email, SMS, etc.) the trouble ticket to an operator to initiate travel to the physical location of the water injection well 202 equipped with a portable flow meter 250.

The operator may place the portable flow meter 250 in proximity or even on the piping 205 of the water injection well and cause the portable flow meter 250 to begin transmitting a second measured flow rate to the computer system 210 (e.g., via a cellular data connection). One of ordinary skill in the art will recognize that automated methods may be implemented for placement of the portable flow meter 250, and/or a second data source 250 may remain in place for each of the water injection wells 202, as desired without departing from the scope of the present disclosure.

When the computer system 210 has received the second measured flow rate from the second data source 250, the second measured flow rate may be compared with the modelled flow rate as determined from the digital model to determine a second flow rate delta (shown as "$FR_{2\Delta}$" in FIG. 3) (step 318). According to some embodiments, when the digital model has been corrected or modified at step 312, the modelled flow rate from the revised digital model may be used for the comparison and determination of the second flow rate delta.

When the second flow rate delta is greater than or equal to the threshold (step 318: yes), it may be determined that the one or more of the digital model, the historical data, and the data source 204, are incorrect, and the entire water injection well and measurement system may be analyzed to determine corrective action (step 324). In such a case, the computer system 210 may automatically issue a trouble ticket and provide the trouble ticket (e.g., via email) to one or more operators with instructions to investigate the issue further. Alternatively, or in addition, the computer system 210 may begin troubleshooting procedures with the intent of providing additional information related to the flow rate measurement issues.

When the second flow rate delta is less than or equal to the threshold (step 318: no), it may be determined that the data source 204 is malfunctioning and that the data source 204 should be remediated (step 320). In other words, when a measured flow rate as provided by the calibrated second data source 250 is accurate and the measured flow rate from the first data source 204 is not accurate, it can be assumed that the first data source 204 is malfunctioning.

According to some embodiments, remediation of the data source 204 may include inspection and/or replacement of one or more sensors of the data source 204 (e.g., the flow rate sensor 226). For example, an orifice plate flow sensor may be inspected for erosion of the orifice plate 230 and other factors that may modify flow characteristics and cause erroneous flow rate measurements. When erosion or other defects are detected in the orifice plate 230, the orifice plate 230 may be repaired or replaced as desired. Similarly, where issues are found with the pressure differential measuring device 235 (e.g., blockage, etc.) the pressure differential measuring device 235 may be repaired or replaced as desired.

When the new flow rate delta is greater than or equal to the threshold (step 322: yes), it may be determined that the orifice plate flow rate data requires to be re-configured in the computer system 210 with data from the newly installed orifice plate (diameter, thickness, etc).

When the data source 204 has been repaired and/or replaced, a new measured flow rate may be obtained from the data source 204, a delta from the anticipated flow rate determined, and the delta compared to the threshold (step 322). When the new flow rate delta between the measured flow rate (i.e., after remediation of the data source 204) and the anticipated flow rate determined by the digital model is less than the threshold (step 322: no), validation of the actual measured flow rate following remediation is achieved, and the process is terminated for the present water injection well 202.

When the new flow rate delta is greater than or equal to the threshold (step 322: yes), it may be determined that one or more of the digital model, the historical data, the data source 204, are still incorrect, and the entire measurement system may be analyzed to determine corrective action (step 324). In such a case, the computer system 210 may automatically issue a trouble ticket and provide the trouble ticket (e.g., via email) to one or more operators with instructions to investigate the issue further.

The described process may be carried out for each well of a plurality of wells 202 in the field 100. Appropriate values, where available, may be applied from previously determined and stored operational records across the plurality of wells 202. For example, historical well data for all wells 202 in a field 100 may be stored and/or accessed for facilitating aspects of the present disclosure, e.g., determining injection volumes and accuracy over time.

Figure 4:
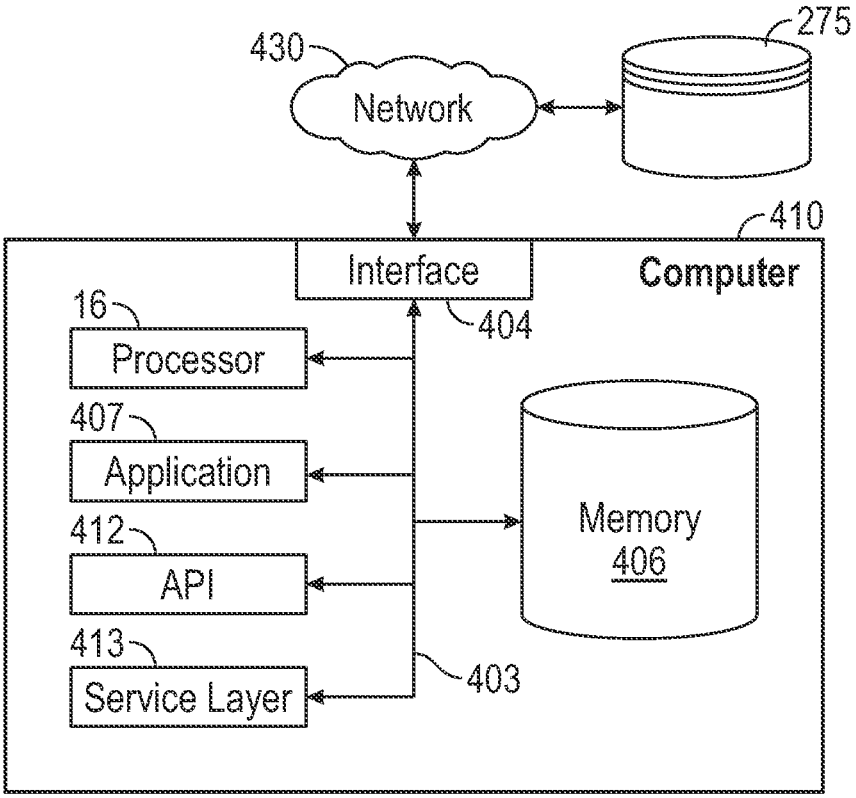
FIG. 4 is a block diagram of a computer used to provide computational functionalities associated with described algorithms, methods, functions, processes, flows, and procedures as described in the instant disclosure, according to an implementation.

FIG. 4 is a block diagram of a computer system 210 used to provide computational functionalities associated with described algorithms, methods, functions, processes, flows, and procedures as described in the instant disclosure, according to an implementation. The illustrated computer system 210 is intended to encompass any computing device such as a server, desktop computer, laptop/notebook computer, wireless data port, smart phone, personal data assistant PDA, tablet computing device, one or more processors within these devices, or any other suitable processing device, including both physical or virtual instances or both of the computing device. Additionally, the computer system 210 may include a computer that includes an input device, such as a keypad, keyboard, touch screen, or other device that can accept user information, and an output device that conveys information associated with the operation of the computer system 210, including digital data, visual, or audio information or a combination of information, or a graphical user interface GUI.

The computer system 210 can serve in a role as a client, a network component, a server, a database or other persistency, or any other component or a combination of roles of a computer for performing the subject matter described in the instant disclosure. The illustrated computer system 210 is communicably coupled with a network 530. In some implementations, one or more components of the computer system 210 may be configured to operate within environments, including cloud-computing-based, local, global, or other environment or a combination of environments.

At a high level, the computer system 210 is an electronic computing device operable to receive, transmit, process, store, or manage data and information associated with the described subject matter. According to some implementations, the computer system 210 may also include or be communicably coupled with an application server, email server, web server, caching server, streaming data server, business intelligence BI server, or other server or a combination of servers.

The computer system 210 can receive requests over network 530 from a client application for example, executing on another computer system 210 and responding to the received requests by processing the said requests in an appropriate software application. In addition, requests may also be sent to the computer system 210 from internal users for example, from a command console or by other appropriate access method, external or third-parties, other automated applications, as well as any other appropriate entities, individuals, systems, or computers.

Each of the components of the computer system 210 can communicate using a system bus 403. In some implementations, any or all of the components of the computer system 210, both hardware or software or a combination of hardware and software, may interface with each other or the interface 404 or a combination of both over the system bus 403 using an application programming interface API 412 or a service layer 413 or a combination of the API 412 and service layer 413. The API 412 may include specifications for routines, data structures, and object classes. The API 412 may be either computer-language independent or dependent and refer to a complete interface, a single function, or even a set of APIs. The service layer 413 provides software services to the computer system 210 or other components whether or not illustrated that are communicably coupled to the computer system 210.

The functionality of the computer system 210 may be accessible for all service consumers using this service layer. Software services, such as those provided by the service layer 413, provide reusable, defined business functionalities through a defined interface. For example, the interface may be software written in JAVA, C++, or other suitable language providing data in extensible markup language XML format or another suitable format. While illustrated as an integrated component of the computer system 210, alternative implementations may illustrate the API 412 or the service layer 413 as stand-alone components in relation to other components of the computer system 210 or other components whether or not illustrated that are communicably coupled to the computer system 210. Moreover, any or all parts of the API 412 or the service layer 413 may be implemented as child or sub-modules of another software module, enterprise application, or hardware module without departing from the scope of this disclosure.

The computer system 210 includes an interface 404. Although illustrated as a single interface 404 in FIG. 4, two or more interfaces 404 may be used according to particular desires or implementations of the computer system 210. The interface 404 is used by the computer system 210 for communicating with other systems in a distributed environment that are connected to the network 430. Generally, the interface 404 includes logic encoded in software or hardware or a combination of software and hardware and operable to communicate with the network 430. More specifically, the interface 404 may include software supporting one or more communication protocols associated with communications such that the network 430 or interface's hardware is operable to communicate physical signals within and outside of the illustrated computer system 210.

The computer system 210 includes at least one computer processor 416. Although illustrated as a single computer processor 416 in FIG. 4, two or more processors may be used according to particular desires or particular implementations of the computer system 210. Generally, the computer processor 416 executes instructions and manipulates data to perform the operations of the computer system 210 and any algorithms, methods, functions, processes, flows, and procedures as described in the instant disclosure.

The computer system 210 also includes a memory 406 configured to store data for the computer system 210 and/or other components or a combination of both that can be connected to the network 430. For example, memory 406 may include a database storing data and/or processing instructions consistent with this disclosure. According to some embodiments, one or more repositories 275 may be stored, for example, in memory 406. Alternatively, or in addition, one or more repositories 275 may be accessed by computer system 210 via the network 430, as desired. Although illustrated as a single memory 406 in FIG. 4, two or more memories may be used according to particular desires and/or implementations of the computer system 210 and the described functionality. While memory 406 is illustrated as an integral component of the computer system 210, in alternative implementations, memory 406 can be external to the computer system 210.

The application 407 comprises one or more algorithmic software engines providing functionality according to particular desires and/or particular implementations of the computer system 210, particularly with respect to functionality described in this disclosure. For example, application 407 can serve as one or more components, modules, applications, etc., as described herein. Further, although illustrated as a single application 407, the application 407 may be implemented as multiple applications 407 on the computer system 210. In addition, although illustrated as integral to the computer system 210, in alternative implementations, the application 407 can be external to the computer system 210.

There may be any number of computer systems 210 associated with, or external to, a computer system containing computer system 210, each computer system 210 communicating over network 430. Further, the term "client," "user," "operator," and other appropriate terminology may be used interchangeably as appropriate without departing from the scope of this disclosure. Moreover, this disclosure contemplates that many users may use one computer system 210, or that one user may use multiple computer systems 210.

While a number of illustrative embodiments have been described in detail above, those skilled in the art will readily appreciate that many modifications are possible in the example embodiments without materially departing from the scope of the present disclosure. For example, according to some embodiments, it may be possible to achieve rapid optimization by utilizing similar operational characteristics for wells determined to be similar to previously optimized wells, such as wells in the same formation, wells with similar fluid properties, and wells with similar pressures and temperature, etc. Additionally, the described process may be carried out at desired intervals for each well in a field of wells.

Throughout the description, including the claims, the term "comprising a" should be understood as being synonymous with "comprising at least one" unless otherwise stated. In addition, any range set forth in the description, including the claims should be understood as including its end values unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

Although the present disclosure herein has been described with reference to particular embodiments, it is to be understood that these embodiments are merely illustrative of the principles and applications of the present disclosure.

It is intended that the specification and examples be considered as illustrative only, with a true scope of the disclosure being indicated by the following claims.

What is claimed:

1. A system for validating a flow rate of a water injection well, the system comprising:

a first data source associated with a piping of the water injection well, and configured to provide operating data associated with the water injection well, the operating data including a first measured flow rate;

a data repository for storing historical injection data for the water injection well;

a digital model corresponding to the water injection well;

a portable second data source configured to provide a second measured flow rate associated with the water injection well; and a processor configured to:

obtain the operating data, the historical data, and the digital model corresponding to the water injection well;

determine a modelled flow rate using the digital model based on the historical injection data and the operating data;

compare the first measured flow rate with the modelled flow rate to determine a first flow rate delta;

in response to determining that the first flow rate delta exceeds a predetermined threshold value, initiate movement of the portable second data source into proximity with the piping to thereby receive the second measured flow rate from the portable second data source;

compare the second measured flow rate to the modelled flow rate to determine a second flow rate delta; and in response to determining that the second flow rate delta does not exceed the predetermined threshold value, automatically generate a request for remediation of the first data source.

2. The system of claim 1, wherein the operating data further comprises one or more of a flow pressure, flow temperature, and a surface choke setting.

3. The system of claim 2, wherein the processor is further configured to:

determine unavailability of one or more of the operating data; and automatically generate a request to verify the first data source.

4. The system of claim 1, wherein the first data source comprises a semi-permanent flow rate measurement device.

5. The system of claim 4, wherein the semi-permanent flow rate measurement device comprises an orifice plate mounted on a portion of the water injection well.

6. The system of claim 1, wherein the portable second data source comprises a portable flow meter removably positioned on a portion of the water injection well.

7. The system of claim 1, wherein the modelled flow rate is determined based on a flow rate equation and a choke equation.

8. The system of claim 1, wherein the processor is further configured to, in response to determining that the first flow rate delta exceeds the predetermined threshold value, and prior to receiving the second measured flow rate from the portable second data source, automatically generate a request to modify the digital model.

9. The system of claim 8, wherein the digital model is modified based on a well system modification.

10. The system of claim 9, wherein the well system modification comprises one or more of a shut-in pressure change, a wireline change, a well workover of a corresponding production well, a well recompletion of a corresponding production well, a change in water pressure supply to the water injection well, and addition of a new production well to a field.

11. A method for validating a flow rate of a water injection well, comprising:

receiving, from a first data source associated with a piping of the water injection well, operating data associated with the water injection well, the operating data including a measured flow rate;

obtaining, from a repository, historical injection data for the water injection well;

obtaining a modelled flow rate from a digital model corresponding to the water injection well based on the historical injection data and the operating data;

comparing the measured flow rate with the modelled flow rate to determine a first flow rate delta;

in response to determining that the first flow rate delta exceeds a predetermined threshold value, moving a portable second data source into proximity with the piping and receiving, from the portable second data source, a second measured flow rate associated with the water injection well;

comparing the second measured flow rate to the modelled flow rate to determine a second flow rate delta;

in response to determining that the second flow rate delta does not exceed the predetermined threshold value, automatically generating a request for remediation of the first data source.

12. The method of claim 11, wherein the operating data further comprises one or more of a flow pressure, flow temperature, and a surface choke setting.

13. The method of claim 12, further comprising:

determining unavailability of one or more of the operating data; and automatically generating a request to verify the first data source.

14. The method of claim 11, wherein the operating data is received via a wired connection from the first data source.

15. The method of claim 11, wherein moving further comprises, positioning by a technician, the portable second data source on a portion of the water injection well, wherein the second measured flow rate is received wirelessly from the portable second data source.

16. The method of claim 11, wherein comparing the measured flow rate with the modelled flow rate comprises a first comparison based on a flow equation and a second comparison based on a choke equation.

17. The method of claim 11, further comprising, in response to determining that the second flow rate delta exceeds the predetermined threshold value, automatically generating a request to modify the digital model.

18. The method of claim 17, further comprising modifying the digital model based on a well system modification.

19. The method of claim 18, wherein the well system modification comprises one or more of a shut-in pressure change, a wireline change, a well workover of a corresponding production well, a well recompletion of a corresponding production well, a change in water pressure supply to the water injection well, and addition of a new production well to a field.

* * * * *